United States Patent [19]

Fulcher

[11] Patent Number: 4,730,942

[45] Date of Patent: Mar. 15, 1988

[54] FLEXIBLE BULK CONTAINERS

[75] Inventor: James E. Fulcher, Knaresborough, England

[73] Assignee: Bowater Packaging Company, London, England

[21] Appl. No.: 897,194

[22] Filed: Aug. 15, 1986

[30] Foreign Application Priority Data

Aug. 19, 1985 [GB] United Kingdom ..... 8520725

[51] Int. Cl.[4] ..... B65D 30/02; B65D 30/10; B65D 33/02; B65D 33/14

[52] U.S. Cl. ..... 383/7; 383/18; 383/24; 383/107; 383/117; 383/119; 383/121; 383/126; 383/908

[58] Field of Search ..... 383/6–8, 383/17, 18, 22, 24, 104, 117, 119, 121, 125, 126, 907, 908, 107, 32

[56] References Cited

U.S. PATENT DOCUMENTS

| | | | |
|---|---|---|---|
| 2,673,024 | 3/1954 | Kuss | 383/121 |
| 4,136,723 | 1/1979 | Skaadel et al. | 383/24 X |
| 4,362,199 | 12/1982 | Futerman | 383/17 X |
| 4,493,109 | 1/1985 | Nattrass | 383/17 X |
| 4,610,028 | 9/1986 | Nattrass | 383/24 X |

*Primary Examiner*—William Price
*Assistant Examiner*—Sue A. Weaver
*Attorney, Agent, or Firm*—Bert J. Lewen; Henry Sternberg

[57] ABSTRACT

A flexible bulk container comprises a tubular side wall structure (1 to 4) of woven fabric, lifting means (13) at an upper end of the side wall structure, and a base (14) closing the lower end of the side wall structure. The base is in the form of a polygon having an even number of sides and comprising a plurality of thicknesses of said woven fabric. Each thickness is formed by two joined flaps of woven fabric forming integral extensions of the side wall structure and each extending from one side of the polygon towards the opposed side thereof. In each thickness of the base, each flap is of substantially right-angled triangle shape having a first adjacent side lying along one side of the polygon and a second adjacent side extending at right angles from said one side to the opposed side of the polygon, and the two flaps are secured together substantially along the hypotenuses thereof.

5 Claims, 3 Drawing Figures

FLEXIBLE BULK CONTAINERS

This invention relates to flexible bulk containers, such as are commonly used for the transportation and storage of free flowing bulk material.

Such containers are generally in the form of large bags or sacks which are often required to carry loads of up to one tonne or more with considerable safety margin above this working load. The containers are commonly made from woven fabric, particularly woven polypropylene or other suitable synthetic material. There have in the past been many proposals for the manufacture of such containers, in particular for providing the containers with lifting loops at the upper part of the container and for providing a base structure at the lower part of the container. Many containers are designed for a single use, after which they are discarded, and price is clearly of major importance in containers of this type. However, safety cannot be sacrificed for cost, and although there are now a number of reasonably satisfactory, relatively low cost solutions for the lifting loops the base construction still presents a problem.

U.S. Pat. No. 4,136,723 describes a flexible container comprising a woven fabric formed into a tube having a closed end at the base thereof. The closed end is formed by lengths of woven fabric extending from opposed wall portions of the tube to form a plurality of base webs traversing each other across the end. Each of the webs is composed of two rectangular lengths of fabric, each length being an integral extension of a respective one of opposed sections of the tube structure, and the two flaps are joined by stitching their free edges together along a stitching line that is substantially parallel to the junction line between the flap and its associated tube section.

For a square-based container there is thus formed a double thickness base which leads to strength improvement over some other containers in this field.

Even adopting this construction, however, the strength of the base is not as high as is required for many applications, and the present invention seeks to provide a construction by way of which a stronger base can be achieved.

According to the invention a flexible bulk container comprises a tubular side wall structure of woven fabric, lifting means at an upper end of the side wall structure, and a base closing the lower end of the side wall structure, the base being in the form of a polygon having an even number of sides and comprising a plurality of thicknesses of said woven fabric, each thickness being formed by two joined flaps of woven fabric forming integral extensions of the side wall structure and each extending from one side of the polygon towards the opposed side thereof, in which, in each thickness of the base, each flap is of substantially right-angled triangle shape having a first adjacent side lying along one side of the polygon and a second adjacent side extending at right angles from said one side to the opposed side of the polygon, and the two flaps are secured together substantially along the hypotenuses thereof. It will be seen that the resultant structure differs from that of U.S. Pat. No. 4,136,723 in that the securing lines for the flaps extend diagonally with respect to the opposed sides of the polygon rather than orthogonally with respect to those sides. A seam effected along a diagonal line can be made stronger than that along an orthogonal line.

Flexible bulk containers are, as already stated, commonly made from woven polypropylene tape, and it is usual to use a square weave, with warp threads extending from top to bottom of the side wall structure and weft threads extending around the side wall structure. If a container according to the invention is of this construction then it will be seen that the cuts required to form the hypotenuses of the flaps are cuts made on the bias with respect to the fabric, and that the resulting seam is therefore a bias seam. This is a very much stronger seam construction than an orthogonal seam, so leading to a significantly improved base. Furthermore a stitched seam on the bias allows each thickness to stretch more than is the case with an orthogonal seam. The two thicknesses can therefore stretch and work together so they are each reacting to the applied load in an optimum manner. This contrasts with base thicknesses having orthogonally stitched seams, wherein one thickness tends to become much more highly stressed than the other so contributing to earlier failure of the container.

In one type of flexible bulk container that is now available the woven fabric comprises a base fabric and a plurality of parallel reinforcing bands woven integrally with the base fabric and extending parallel to the axis of the tubular side wall structure. Lifting loops may either be integral with, or connected to, such reinforcing bands at the upper end of the side wall structure, for example as described in U.S. Pat. No. 4,610,028. The invention is of particular application to containers made of such fabric, and in a preferred embodiment of the invention in at least one thickness of the base each flap has a reinforcing band therein that is an integral extension of a reinforcing band in that region of the side wall structure from which that flap is an integral extension, and the reinforcing bands in the two flaps are joined end to end. Thus, rather than forming the container base merely by joining together two sections of a relatively weak base fabric, the base also includes joined sections of a reinforcing band that extends into the opposed sections of the side wall structure. There is thus a continuous reinforcement through one part of the side wall structure, the base and the opposed part of the side wall structure.

As stated, the container is applicable to containers which have a base formed as a polygon with an even number of sides, and the number of thicknesses of woven fabric in the base will be equal to half the number of sides. It is preferred that the polygon is a rectangle, and particularly a square, and there will then be two fabric thicknesses in the base. The base shape defines the overall approximate cross-sectional shape of the container, and if the base is square then the side wall structure can also be taken as substantially square. If, in such structure, each of the four individual side walls incorporates two parallel reinforcing bands then the upper ends of the bands adjacent to a side wall junction may be joined to form a lifting loop extending over that corner of the container. If this is done at each of the four corners then the container will have four lifting loops. In this structure each base flap will have two reinforcing bands extending therein, and the bands are desirably disposed so that their ends abut and are joined when the flaps are secured together along their hypotenuses.

Preferably the container is formed from a single length of tubular woven fabric in order to obtain maximum strength without the need for seams. Other constructions are, however, possible. Formation of a tubular woven fabric having integral reinforcing bands extending parallel to the axis of the tube can readily be achieved by conventional weaving techniques. The reinforcing bands may be provided, for example, by the cramming of warp threads in the region of the reinforcing band, i.e. by making the warps per centimeter in the reinforcing band regions greater than the number of warps per centimeter in the base fabric of the tube. Alternatively, the reinforcing bands may incorporate warp yarn of a higher tensile strength than the warp yarns of the base fabric. These higher strength yarns may replace entirely the warp yarns used for the base fabric, or they may be used in addition to those warp yarns so that each reinforcing band will incorporate both base fabric warp yarns and higher strength warp yarns. In a preferred arrangement the material of the tube may be woven fabric having polypropylene warp and weft threads interwoven in any appropriate weaving pattern, usually square woven as already explained, although twill, basket and rib weaves may also be used. Interwoven with the polypropylene weft threads in the regions of the reinforcing bands are additional warp threads having a higher tensile strength than the base polypropylene warp threads. The reinforcing threads may be made from any suitable natural fibre or from yarn of synthetic or semisynthetic polymer, such as polyester, polyamide, polyolefin or polyacrylic. The higher strength warp threads may alternatively also be of polypropylene, which may be of a higher count than the base polypropylene threads or may be a thread similar to the base thread which has been treated, e.g. by fibrillation, in order to increase its tensile strength. The suggested materials given in this paragraph do not constitute an exhaustive list, and other materials that can be used will be apparent to those skilled in the art.

Use of tubular woven fabric also gives cost advantages, and the strength of the base may be such that a lighter fabric may be used, so further reducing cost.

The top of the container may be open or, more preferably, may be closed by a top stitched to the side wall structure and adjacent to the lifting loops. The top may be formed with any suitable opening and/or skirt arrangement and, if required, a discharge arrangement may be formed in the base of the container even though this may somewhat weaken the base. The container may also be provided with an inner, impervious liner within which the load is contained, to give added protection against the ingress of moisture, and also to prevent fine material escaping from the container.

In order that the invention may be better understood a container in accordance therewith will now be described in more detail, by way of example only, with reference to the accompanying drawings in which.

Figure 1:
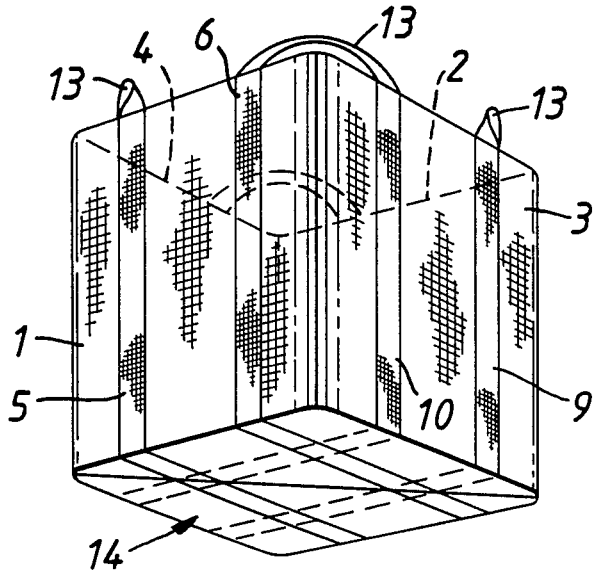
FIG. 1 is a perspective view of the container.

Referring to FIG. 1 this shows a flexible bulk container comprising a side wall structure having a first pair of opposed side walls 1 and 2, and a second pair of opposed side walls 3 and 4, the side wall structure being formed from a single length of tubular woven fabric. The fabric comprises a base fabric and eight parallel reinforcing bands 5 to 12 woven integrally with the base fabric and extending parallel to the axis of the tube. At each of the four upper corners of the bag extensions of the respective reinforcing bands extend above the side walls and are joined to form four lifting loops 13.

U.S. Pat. No. 4,610,028 describes in more detail one way in which such lifting loops may be provided.

Figure 2:
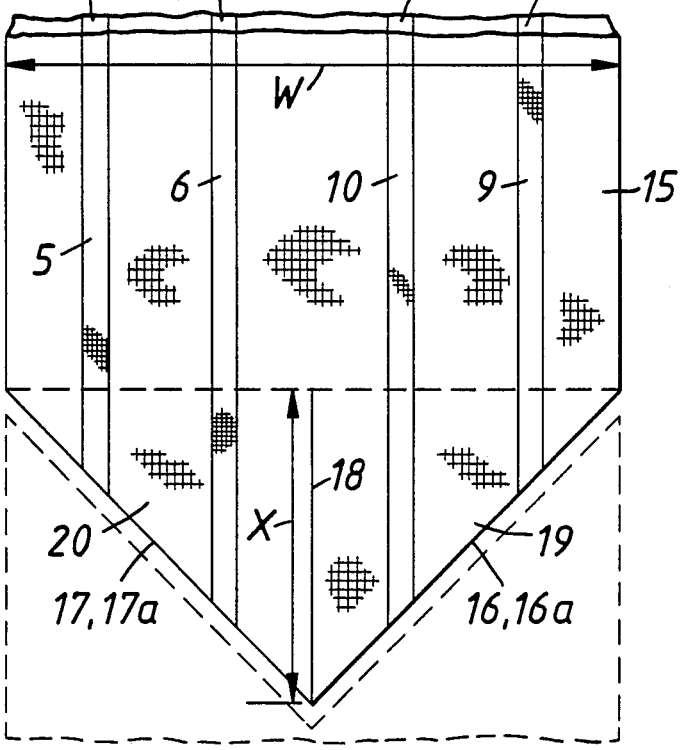
FIG. 2 shows one stage in the manufacture of the container of FIG. 1 from a length of woven tubular fabric.
Figure 3:
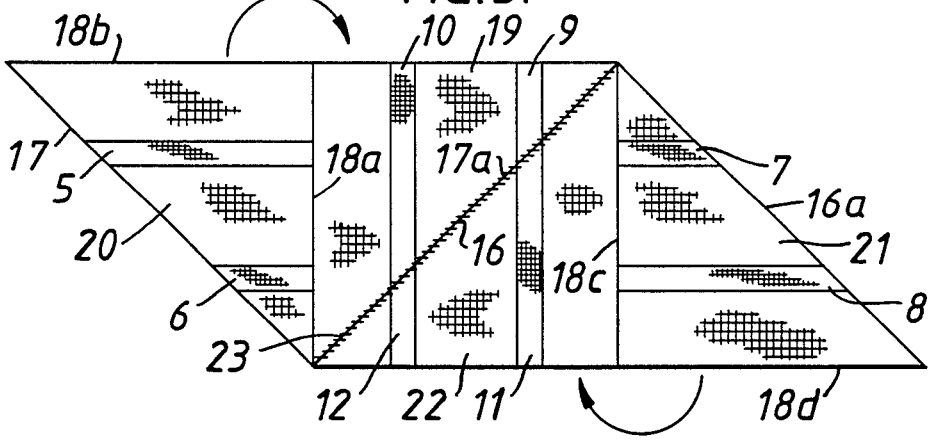
FIG. 3 shows a further stage in the manufacture of the container of FIG. 1.

The container has a base 14, the construction of which will best be understood by considering also the manufacturing method, with reference to FIGS. 2 and 3. The container shown is formed from a single length 15 of tubular woven fabric which is folded so that the reinforcing bands 5, 6, 10 and 9 are superimposed on reinforcing bands 12, 11, 8 and 7 respectively. The fabric is square woven, with the warp threads extending parallel to the reinforcing bands and the weft threads at right angles thereto. The reinforcing bands are formed by additional warp threads or stronger warp threads in any manner as already described.

To form the base structure for the container a V-shaped cut is made across the fabric, the two cut sections 16, 17 (and **16*a*, 17*a* in the lower sheet of the fabric) each making an angle of 45° to the axis of the tube. Additionally, a central cut 18 is made from the apex of the V-shaped cut for a distance X that is equal to half the width W of the folded fabric. It will be seen that the cutting action effectively forms four triangular flaps of fabric, each integral with the main body of the fabric, flaps 19 and 20 lying to opposite sides of the cut 18, and flaps 21 and 22 lying immediately below the respective flaps 19 and 20. Each flap is in the form of an isosceles right-angle triangle having adjacent sides that are equal to the length of the cut 18** and thus half the folded width of the fabric.

The fabric is also cut across its width at a location spaced from the base structure so that the upper part of the container may be formed. Either before or after formation of the upper part the base structure is completed as shown with reference to FIG. 3. With the tubular fabric folded to square configuration it will be seen that it comprises four side walls each with an integral triangular flap extending therefrom. Flaps 19 and 22 of opposed side walls are folded so that their cut edges **17*a* and 16 forming the hypotenuses of the triangular flap lie adjacent to or slightly overlapping each other and the two edges are then joined by stitching a suitable seam 23. It will be seen that the seam not only joins the base fabric on the bias, but also that it joins the aligned reinforcing band sections 9 and 11 and the aligned reinforcing band sections 10 and 12**.

FIG. 3 shows the triangular flaps 20 and 21 of the other pair of opposed side walls folded outwardly from the container base, and in order to complete the base these two flaps are folded inwardly as indicated by the arrows and the cut edges **16*a* and 17, forming the hypotenuses of the triangles, are joined by a further suitable seam. Once again, it will be seen that this joins the base fabric of the respective flaps on the bias and also that it joins the aligned reinforcing bands 5 and 7 and the aligned reinforcing bands 6 and 8. The result is thus the two-ply base structure shown in FIG. 1**.

It will be seen that although each of the triangular flaps 19 to 22 is an integral extension of its associated side wall it is not, as yet described, secured directly to any other side wall. It is not necessary for such connections to be made, particularly if the container is to be used with an inner liner. However, if required the edges **18*a* and 18*c* of the flaps 19 and 22, formed by the cut 18, may be stitched to the lower edges of the side walls from which the flaps 20 and 21 extend. Alternatively, the edges 18*b* and 18*d* of flaps 20 and 21 may be stitched to the lower edges of the side walls from which the flaps 19 and 22 extend. In another embodiment all four edges 18***a* to 18*d* may be stitched to the respective side walls to form a particularly secure structure.

It will be noted from FIG. 2 that the V-shaped cut leaves an adjacent length of fabric 30 with an inverse cut. By simply taking that length and re-folding it into a plane perpendicular to the plane of the paper it will be noted that the end will then correspond to that of the main fabric length. A cut similar to cut 18 may then be made and a container base formed at the end of the fabric length 30, an upper part construction being formed at the opposite end of that length. Thus, no fabric is wasted.

It will be understood that many modifications may be made, and in particular that the container need not be of square configuration, that the configuration of reinforcing bands in the fabric may be different from that shown, and indeed that the fabric may even be devoid of reinforcing bands.

I claim:

1. A flexible bulk container comprising a tubular side wall structure of a square woven polypropylene fabric, with warp threads extending from top to bottom of the side wall structure and weft threads extending around the side wall structure, lifting means at an upper end of the side wall structure, and a base closing the lower end of the side wall structure, the base being in the form of a polygon having an even number of sides and comprising a plurality of thicknesses of said woven fabric, each thickness being formed by two joined flaps of woven fabric forming integral extensions of the side wall structure and each extending from one side of the polygon towards the opposed side thereof, in which, in each thickness of the base, each flap is of substantially right-angled triangle shape having a first adjacent side lying alone one side of the polygon and a second adjacent side extending at right angles from said one side to the opposed side of the polygon, and the two flaps are secured together substantially along the hypotenuses thereof, the hypotenuses of the flaps being on the bias with respect to the fabric, and the resulting seam being a bias seam.

2. A flexible bulk container according to claim 1 in which the woven fabric comprises a base fabric and a plurality of parallel reinforcing bands woven integrally with the base fabric and extending parallel to the axis of the tubular side wall structure, and in at least one thickness of the base each flap has a reinforcing band therein that is an integral extension of a reinforcing band in that region of the side wall structure from which that flap is an integral extension, and the reinforcing bands in the two flaps are joined end to end.

3. A flexible bulk container according to claim 1, in which the container has a rectangular base, with two fabric thicknesses in the base.

4. A flexible bulk container according to claim 3 in which the base is square, the side wall structure is substantially square, each of the four individual side walls incorporates two parallel reinforcing bands, the upper ends of the bands adjacent to each side wall junction being joined to form a lifting loop extending over that corner of the container, each base flap has two reinforcing bands extending therein, and the bands are disposed so that their ends abut and are joined when the flaps are secured together along their hypotenuses.

5. A flexible bulk container according to claim 1, formed from a single length of tubular woven fabric.

* * * * *